US010065663B2

(12) United States Patent
Katahira et al.

(10) Patent No.: US 10,065,663 B2
(45) Date of Patent: Sep. 4, 2018

(54) STEERING BOGIE AND VEHICLE

(71) Applicant: MITSUBISHI HEAVY INDUSTRIES, LTD., Tokyo (JP)

(72) Inventors: Kousuke Katahira, Tokyo (JP); So Tamura, Tokyo (JP); Mitsuaki Hoshi, Tokyo (JP)

(73) Assignee: MITSUBISHI HEAVY INDUSTRIES ENGINEERING, LTD., Kanagawa (JP)

( * ) Notice: Subject to any disclaimer, the term of this patent is extended or adjusted under 35 U.S.C. 154(b) by 197 days.

(21) Appl. No.: 15/031,271

(22) PCT Filed: Sep. 4, 2014

(86) PCT No.: PCT/JP2014/073342
§ 371 (c)(1),
(2) Date: Apr. 22, 2016

(87) PCT Pub. No.: WO2015/075995
PCT Pub. Date: May 28, 2015

(65) Prior Publication Data

US 2016/0272222 A1 Sep. 22, 2016

(30) Foreign Application Priority Data

Nov. 22, 2013 (JP) ..... 2013-241858

(51) Int. Cl.
*B61F 13/00* (2006.01)
*B61F 5/38* (2006.01)
(Continued)

(52) U.S. Cl.
CPC ..... *B61F 5/38* (2013.01); *B61B 13/00* (2013.01); *B61F 3/16* (2013.01); *B61F 5/32* (2013.01); *B61F 9/00* (2013.01)

(58) Field of Classification Search
CPC ..... B61F 5/32; B61F 5/38; B61F 3/16; B61F 9/00; B61B 13/00
See application file for complete search history.

(56) References Cited

U.S. PATENT DOCUMENTS 4,223,611 A * 9/1980 Dawson ..... B62D 1/26 104/119
8,161,889 B2 * 4/2012 Morichika ..... B62D 1/265 104/243
(Continued)

FOREIGN PATENT DOCUMENTS

JP 50-117115 A 9/1975
JP 51-132517 A 11/1976
(Continued)

OTHER PUBLICATIONS

International Search Report in PCT Application No. PCT/JP2014/073342, dated Dec. 2, 2014.
(Continued)

*Primary Examiner* — Jason C Smith
(74) *Attorney, Agent, or Firm* — Kanesaka Berner and Partners LLP

(57) ABSTRACT

A steering bogie provided with a pair of tires (13) positioned on both sides in the vehicle-widthwise direction, a primary suspension mechanism (51) for supporting the pair of tires (13) independent from a subframe (11), and a steering guide device (14) which is guided along guide rails (6) extending along a track (5), wherein the steering guide device (14) is equipped with: a guide frame (31); guide wheels (33) which roll as a result of contact with the guide rails (6), and are rotatably supported by the guide frame (31); and a guide frame support mechanism (32) for supporting the guide frame (31) by hanging from the primary suspension mechanism (51).

10 Claims, 8 Drawing Sheets

(51) Int. Cl.

| | |
|---|---|
| ***B61B 13/00*** | (2006.01) |
| ***B61F 9/00*** | (2006.01) |
| ***B61F 3/16*** | (2006.01) |
| ***B61F 5/32*** | (2006.01) |

(56) References Cited

U.S. PATENT DOCUMENTS

| | | | | |
|---|---|---|---|---|
| 9,061,690 | B2 * | 6/2015 | Kanemori | B61B 10/04 |
| 9,452,763 | B2 * | 9/2016 | Maeyama | B62D 1/265 |
| 9,821,824 | B2 * | 11/2017 | Maeyama | B61B 13/04 |
| 2012/0031298 | A1 * | 2/2012 | Kurahashi | B61B 10/04 105/215.2 |
| 2012/0103227 | A1 * | 5/2012 | Maeyama | B61B 13/00 104/245 |
| 2016/0207548 | A1 * | 7/2016 | Katahira | B61B 13/00 |
| 2016/0251002 | A1 * | 9/2016 | Katahira | B61B 13/00 105/182.1 |
| 2016/0257315 | A1 * | 9/2016 | Yanobu | B61F 5/38 |
| 2016/0264156 | A1 * | 9/2016 | Yanobu | B61B 13/04 |
| 2016/0272222 | A1 * | 9/2016 | Katahira | B61B 13/00 |

FOREIGN PATENT DOCUMENTS

| | | | |
|---|---|---|---|
| JP | 53-152310 | U | 11/1978 |
| JP | 54-131210 | A | 10/1979 |
| JP | 58-11341 | A | 1/1983 |
| JP | 59-29559 | A | 2/1984 |
| JP | 60-229856 | A | 11/1985 |
| JP | 60-229857 | A | 11/1985 |
| JP | 11-321635 | A | 11/1999 |

OTHER PUBLICATIONS

Written Opinion in PCT Application No. PCT/JP2014/073342, dated Dec. 2, 2014.

* cited by examiner

STEERING BOGIE AND VEHICLE

TECHNICAL FIELD

The present invention relates to a steering bogie and a vehicle.

Priority is claimed on Japanese Patent Application No. 2013-241858, filed Nov. 22, 2013, the content of which is incorporated herein by reference.

BACKGROUND ART

As new transportation means other than buses or railroads, track-based transportation systems that travel on a track by means of running wheels having elasticity, such as rubber tires, are known. Such track-based transportation systems are generally referred to as new transportation systems or automated people movers (APMs).

In the track-based transportation system, a pair of steering bogies is provided on the front and rear of a lower part of a car body.

Each steering bogie, for example as illustrated in PTL 1, includes an axle that is rotatably supported by a subframe, running wheels coupled to both ends of the axle, and a steering guide device having guide wheels that roll in contact with guide rails provided along a track. In this way, in the steering bogie, an axle suspension type in which the a pair of running wheels is respectively coupled to both the ends of the axle is adopted, and displacement in an upward-downward direction is allowed by an air spring provided between the subframe that supports the axle, and an underframe of a car body.

Meanwhile, it is general that the above-described steering guide device is hung and supported, for example, from the level of the axle in a spring lower portion of the air spring.

According to this configuration, unlike a case where the steering guide device is hung and supported from the spring upper portion (for example, the car body or the like) of the air spring, it is not necessary to take the displacement of the air spring into consideration with respect to the displacement of a guide frame. Thus, it is considered that the displacement of the steering guide device in the upward-and-downward direction can be suppressed so that the guide wheels falls within the rail width of the guide rails.

CITATION LIST

Patent Literature

[PTL 1] Japanese Unexamined Patent Application Publication No. 59-29559

SUMMARY OF INVENTION

Technical Problem

Here, in recent years, a configuration adopting an independent suspension type in which a pair of running wheels disposed on both sides in a vehicle width direction is supported so as to be displaceable upward and downward respectively has been studied.

In this case, since a suspension mechanism or the like is disposed, between the steering guide device and the axle, layout performance is low, and it is difficult to hang the steering guide device from the axle. Therefore, it is considered that the steering guide device is hung from the car body.

However, in a case where the steering guide device is hung from the car body, the displacement of the entire steering bogie including the air spring and the running wheels affects the upward-and-downward displacement of the steering guide device. Therefore, the upward-and-downward displacement of the steering guide device becomes large. In this case, in the rail width of existing guide rails, there is a concern that the guide wheels may stick out from the guide rails. For this reason, there is a problem in that there is the necessity for newly installing guide rails with a larger rail width, which leads to an increase in facility cost, or the like.

The invention provides a steering bogie and a vehicle that can suppress the upward-and-downward displacement of a steering guide device in a rail width direction of guide rails as well as suppressing an increase in facility cost.

Solution to Problem

A steering bogie related to a first aspect of the invention includes a pair of running wheels that is disposed on both sides in a vehicle width direction; a suspension mechanism that supports the pair of running wheels independently from a frame; and a steering guide device that is guided along a guide rail extending along a track. Here, the steering guide device includes a guide frame, a guide wheel that is configured to roll as a result of contact with the guide rail and is rotatably supported by the guide frame, and a guide frame support mechanism that supports the guide frame by hanging from the suspension mechanism.

According to the steering bogie having such a configuration, the guide frame support mechanism that supports the guide frame by hanging from the suspension mechanism is provided. For this reason, unlike a configuration in which the guide frame is supported by being hung from the car body like the related-art independent suspension type, the guide frame can be supported from below an air spring that elastically supports of the car body. Accordingly, since it is not necessary to take the displacement of the air spring into consideration with respect to the displacement of the guide frame, the upward-and-downward displacement of the guide frame can be suppressed so that the guide wheel falls within the rail width of the guide rail. As a result, even in a case where a suspension mechanism of an independent suspension type is adopted, it is possible to use an existing guide rail, and an increase in facility cost can be suppressed.

Additionally, in the steering bogie related to a second aspect of the invention, the guide frame support mechanism in the above first aspect may include a pair of hanging links that supports the guide frame so as to be rockable in the vehicle width direction with respect to the suspension mechanism.

According to this configuration, the guide frame support mechanism includes the hanging links that supports the guide frame so as to be rockable in the vehicle width direction with respect to the suspension mechanism. For this reason, the displacement of the suspension mechanism can be restrained from being hindered by the guide frame, and the suspension mechanism can be smoothly displaced.

Additionally, in the steering bogie related to a third aspect of the invention, the pair of hanging links in the above second aspect may extend so that the spacing between the pair of hanging links in the vehicle width direction becomes narrow as the hanging links become closer to one side running in an upward-downward direction.

According to this configuration, the pair of hanging links extends so that the spacing between the pair of hanging links in the vehicle width direction becomes narrow as the hanging links become closer to one side running in the upward-downward direction. Therefore, the guide frame can be smoothly displaced with respect to the upward-and-downward displacement or the like of the suspension mechanism.

Additionally, in the steering bogie related to a fourth aspect of the invention, the pair of hanging links in the above second aspect may extend parallel to each other in an upward-downward direction.

According to this configuration, components in the upward-downward direction when the guide frame and the frame are displaced relative to each other in the vehicle width direction via the hanging links can be made small. That is, the guide frame and the frame are easily displaced relative to each other in the vehicle width direction, and the inclination or the like of the guide frame in the upward-downward direction with respect to the frame can be suppressed.

Additionally, in the steering bogie related to a fifth aspect of the invention, the guide frame support mechanism in any one of the above first to fourth aspects may include a restricting part that restricts the displacement of the guide frame in the vehicle width direction relative to the frame within a predetermined range.

According to this configuration, the restricting part that restricts the displacement of the guide frame in the vehicle width direction relative to the frame within a predetermined range is provided. For this reason, the shaking of the guide frame in the vehicle width direction with respect to the frame can be suppressed, and a reaction force can be more easily transmitted from the guide rail to the guide wheel. Accordingly, the steering guide device can be guided along the guide rail.

Additionally, in the steering bogie related to a sixth aspect of the invention, the guide frame support mechanism in the above fifth aspect may include a base part that supports the guide frame, and a pair of hanging links that supports the base part so as to be rockable in the vehicle width direction with respect to the suspension mechanism, and the restricting part may have elastic members that are provided in the pair of hanging links, extend toward the suspension mechanism or the base part, and are elastically deformable in a direction of the extension.

According to this configuration, when the guide frame rocks in the vehicle width direction, the pair of hanging links inclines, and the base part, that is, the guide frame inclines with respect to a suspension device. In this case, the spacing between one hanging link at a position where an elastic member is provided, and the suspension device becomes small, the elastic members are elastically deformed under forces from the suspension device or the base part, and biasing forces act toward the hanging links from the suspension device or the base part. These biasing forces become forces to restore the guide frame to its initial state where the guide frame does not rock, that is, a state where the guide frame is disposed in the vehicle width direction. Therefore, the shaking of the guide frame in the vehicle width direction with respect to the frame can be suppressed, and a reaction force can be more easily transmitted from the guide rail to the guide wheel. Accordingly, the steering guide device can be guided along the guide rail. Moreover, since the elastic members merely have to be provided in the hanging links, the installation of the elastic members is easy, and the elastic members can be easily replaced, which leads to improvements in maintenance.

Additionally, in the steering bogie related to a seventh aspect of the invention, the guide frame support mechanism in the above fifth aspect may include a base part that supports the guide frame, and a pair of hanging links that supports the base part so as to be rockable in the vehicle width direction with respect to the suspension mechanism, and the restricting part may have an elastic member that is provided in the base part, extends toward the suspension mechanism, and is elastically deformable in a direction of the extension.

According to this configuration, when the guide frame rocks in the vehicle width direction, the pair of hanging links inclines, and the base part, that is, the guide frame inclines with respect to the suspension device, and the guide frame approaches the suspension device on one side in the width direction. In this case, the spacing between the base part at a position where the elastic member is provided, and the suspension device becomes small, the elastic member is elastically deformed under a force from the suspension device, and a biasing force acts toward the guide frame from the suspension device. This biasing force becomes a force to restore the guide frame to its initial state where the guide frame does not rock, that is, a state where the guide frame is disposed in the width direction. Therefore, the shaking of the guide frame in the vehicle width direction with respect to the frame can be suppressed, and a reaction force can be more easily transmitted from the guide rail to the guide wheel. Accordingly, the steering guide device can be guided along the guide rail. Moreover, since the elastic member merely has to be provided in the base part, the installation of the elastic member is easy, and the elastic member can be easily replaced, which leads to improvements in maintenance.

Additionally, in the steering bogie related to an eighth aspect of the invention, the guide frame support mechanism in the above fifth aspect may include a base part that supports the guide frame, a pair of hanging links that is provided apart from each other in the vehicle width direction between the base part and the suspension mechanism, and a joint part that is provided between each of the pair of hanging links, and the base frame and the suspension mechanism, and turns the base part and the suspension mechanism relative to each hanging link relative with an axis, extending in a direction intersecting the vehicle width direction and an upward-downward direction, as a center, thereby supporting the guide frame so as to be rockable in the vehicle width direction with respect to the suspension mechanism, and the restricting part may have an elastic member that is provided in at least one of the joint parts and generates an elastic restoring force during the relative turning.

According to this configuration, when the guide frame rocks in the vehicle width direction, the pair of hanging links inclines, and the guide frame inclines with respect to the suspension device. In this case, in the joint parts, the guide frame, the suspension mechanism, and the hanging link turn relative to each other with the axis as a center. Therefore, the elastic member is elastically deformed, and a restoring force to restore the guide frame to its initial state where the guide frame does not rock, that is, a state where the guide frame is disposed in the vehicle width direction, is generated. Therefore, the shaking of the guide frame in the vehicle width direction with respect to the frame can be suppressed, and a reaction force can be more easily transmitted from the guide rail to the guide wheel. Accordingly, the steering guide device can be guided along the guide rail.

Additionally, the steering bogie related to a ninth aspect of the invention may further include a turning bearing that is disposed between the guide frame support mechanism in any one of the above first to eighth aspects and the guide frame and supports the guide frame so as to be turnable around a turning axis extending in an upward-downward direction with respect to the guide frame support mechanism; and a steering mechanism that steers the running wheels in an interlocking manner with the turning of the guide frame.

According to this configuration, if the guide wheel comes into contact with the guide rail at the time of traveling, the guide wheel rolls and a reaction force acts toward the guide wheel from the guide rail. If the guide wheel receives the reaction force, the guide frame is pressed in the vehicle width direction, and thereby, the guide frame turns around the turning axis.

If the guide frame turns around the turning axis, the steering mechanism is displaced in an interlocking manner with this turning, and thereby, the running wheels are steered. Accordingly, since the running wheels are steered according to the curvature radius of the guide rail, the steering bogie can be made to travel smoothly.

Additionally, a vehicle related to a tenth aspect of the invention includes a car body; and the steering bogie in any one of the first to ninth aspects that is provided in a lower part of the car body.

According to this configuration, the above steering bogie is provided. Therefore, it is possible to provide a vehicle that can suppress the displacement of the steering guide device in the rail width direction of the guide rail and has excellent traveling stability as well as suppressing an increase in facility cost.

Advantageous Effects of Invention

In the above steering bogie and the above vehicle, as well as an increase in facility cost being suppressed, the displacement of the steering guide device in the width direction of the guide rail can be suppressed.

DESCRIPTION OF EMBODIMENTS

Next, embodiments of the invention will be described with reference to the drawings.

First Embodiment

Figure 1:
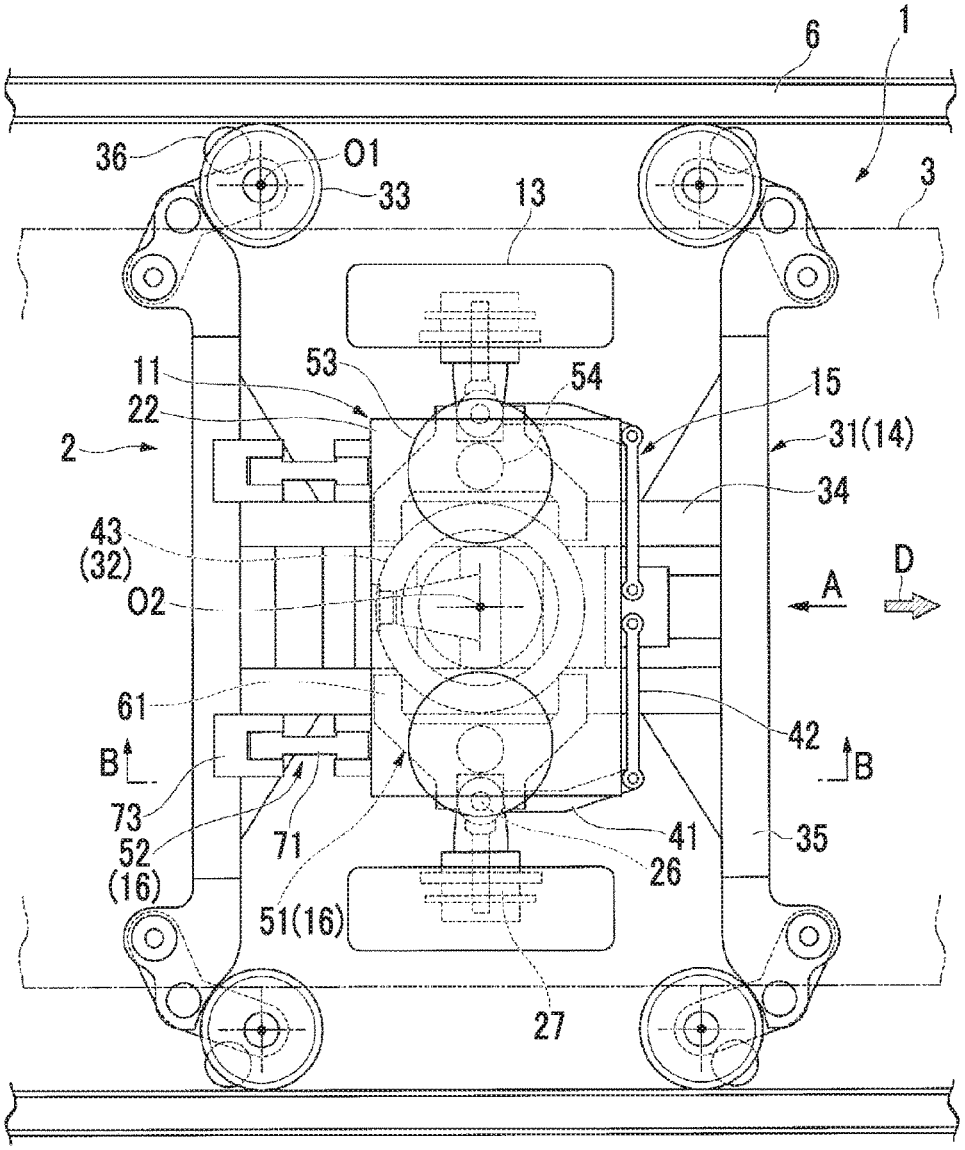
FIG. 1 is a plan view illustrating an aspect in which a vehicle in a first embodiment travels along a linear portion of a track.
Figure 2:
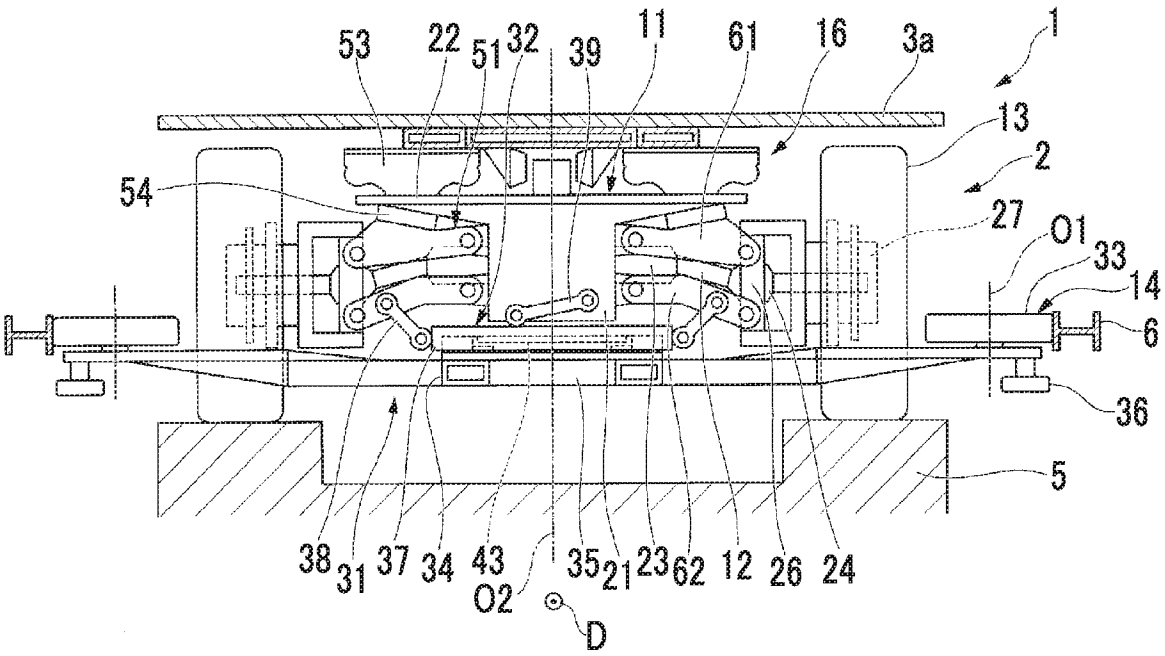
FIG. 2 is a view as seen from arrow A of FIG. 1.
Figure 3:
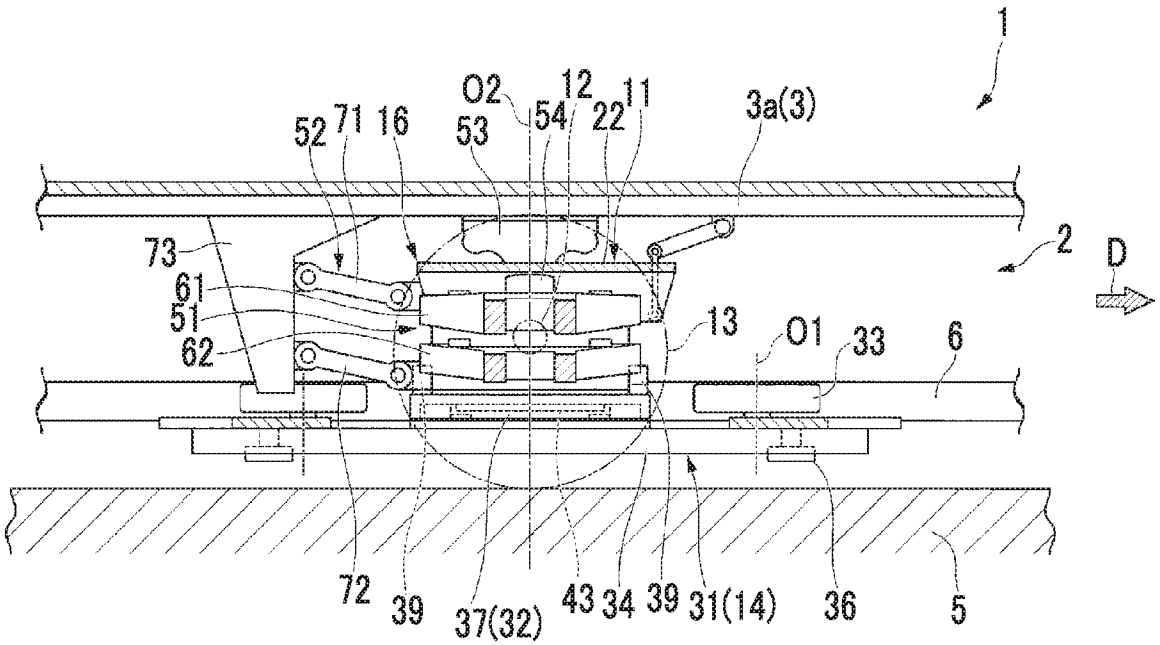
FIG. 3 is a sectional view taken along line B-B of FIG. 1.

As illustrated in FIGS. 1 to 3, a vehicle 1 is a vehicle of a track-based transportation system that travels on a track 5 while being guided by guide rails 6 provided at the track 5. In the present embodiment, the vehicle 1 is a vehicle of a side guide rail type (side guide type) transportation system in which guide rails 6 extending in an extending direction of the track 5 are provided on both sides of the track 5 in a width direction.

<Vehicle>

The vehicle 1 includes steering bogies 2 that travel on the track 5, and a car body 3 (refer to FIG. 1) that is supported by the steering bogies 2.

Directions, such as the front, the rear, the top, the bottom, the left, and the right, in the following description are the same as the directions of the vehicle unless particularly mentioned. Additionally, in the following, a direction of arrow D in a forward-rearward direction of the vehicle 1 is referred to as the front, and a direction opposite to the direction of arrow D is referred to as the rear. Moreover, a direction toward a subframe 11 (to be described below) arranged at a central part of each steering bogie 2 in a leftward-rightward direction, is referred to as an inner side, and a direction away from the subframe 11 is referred to as an outer side.

As illustrated in FIG. 1, the car body 3 has a rectangular parallelepiped shape that is long in the forward-rearward direction, and a space capable of accommodating passengers is formed inside the car body. A pair of the above-described steering bogies 2 is provided on the front and rear of a lower part of the car body 3. Here, since a steering bogie 2 on the front side and a steering bogie 2 on the rear side have the same configuration except that the forward and rearward directions are reversed, one steering bogie 2 (on the front side) will be representatively described below.

<Steering Bogie>

As illustrated in FIGS. 1 to 3, the steering bogie 2 includes a pair of left and right power transmission shafts 12 (refer to FIG. 2) that is rotatably supported by the subframe (frame) 11, tires (running wheels) 13 to which rotative forces are transmitted by the respective power transmission shafts 12, a steering guide device 14 that is guided by the guide rails 6, a steering mechanism 15 (refer to FIG. 1) that steers the tires 13 according to displacement of the steering guide device 14, and a suspension device 16 that is arranged between an underframe 3*a* of the car body 3 and the tires 13.

The subframe 11 includes a basal part 21 that is formed in a T shape in a front view as seen from the forward-rearward direction as illustrated in FIG. 2 and is located at a central part in the leftward-rightward direction (vehicle width direction), and a pair of spring receptacles 22 extending toward both sides in the leftward-rightward direction, respectively, from an upper end of the basal part 21. A gear mechanism (not illustrated), such as a speed reduction gear and a differential gear, for transmitting the rotational power from a driving source, such as a motor (not illustrated), to the power transmission shafts 12 are housed within the basal part 21.

As illustrated in FIG. 2, each power transmission shaft 12 extends in the leftward-rightward direction, and an inner end thereof in the leftward-rightward direction is coupled to the gear mechanism within the basal part 21 via a swingable joint 23. That is, the rotational power transmitted from the driving source via the gear mechanism is distributed to the power transmission shafts 12, and the power transmission shafts 12 rotate.

An outer end of each power transmission shaft 12 in the leftward-rightward direction is coupled to a tire attachment shaft 27 via a swingable joint 24. Each tire attachment shaft 27 is rockable around a kingpin 26 (refer to FIG. 1) extending in the upward-downward direction. That is, the kingpin 26 has a function as a steering shaft of a tire 13.

A tire (running wheel) 13 made of a material having elasticity, such as rubber is separately attached to each tire attachment shaft 27. As the tires 13, for example, core type tires that have a core housed therein may be used, and tires with no core used for general trucks, general buses, or the like may be used.

In the core-type tires, exclusive jigs or exclusive tools are required at the time of the replacement of the tires, and replacement work is also difficult. Hence, since the tires with no core used for general trucks or buses is used as the tires 13, it is possible to reduce costs or reduce time and effort for the replacement work of the tires.

(Suspension Device)

As illustrated in FIG. 2, the suspension device 16 includes a primary suspension mechanism 51 that supports the above-described respective tires 13 so as to be displaceable independently in the upward-downward direction with respect to the subframe 11, a second suspension mechanism 52 (refer to FIG. 3) that supports the subframe 11 so as to be displaceable in the upward-downward direction with respect to the underframe 3*a*, air springs 53 that are arranged between above-described underframe 3*a* and the spring receptacles 22 of the subframe 11, and elastic members 54 that are arranged between the spring receptacles 22 and the primary suspension mechanism 51.

The primary suspension mechanism 51 is an independent suspension mechanism of a so-called double wishbone type. The primary suspension mechanism 51 includes a pair of left and right upper arms 61 and a pair of left and right lower arms 62 extending in the leftward-rightward direction.

Each upper arm 61 is formed in an H shape in a plan view as seen from above, and both ends thereof in the leftward-rightward direction are respectively bifurgated with respect to a central part thereof. An inner end of the upper arm 61 in the leftward-rightward direction is pin-coupled to the basal part 21 of the subframe 11, and an outer end thereof is pin-coupled to the above-described kingpin 26.

Each lower arm 62 is formed in an H shape in a plan view as seen from above, and both ends thereof in the leftward-rightward direction are respectively bifurgated with respect to a central part thereof. An inner end of the lower arm 62 in the leftward-rightward direction is pin-coupled to the basal part 21 of the subframe 11 below the upper arm 61, and an outer end thereof is pin-coupled to the above-described kingpin 26 below the upper arm 61.

When the tires 13 are displaced in the upward-downward direction due to irregularities of the track 5, the primary suspension mechanism 51 is made rockable in the upward-downward direction with respect to the tires 13 and the subframe 11.

Each elastic member 54 is made of rubber or the like and is separately disposed between an upper surface of each upper arm 61 and a lower surface of each spring receptacle 22. The elastic member 54 is configured so as to be elastically deformed with the displacement or the like of the primary suspension mechanism 51 and thereby absorb the vibration input to the tires 13 in a preceding stage to which vibration is transmitted to the subframe 11.

As illustrated in FIG. 3, the second suspension mechanism 52 is a so-called parallel link mechanism, and includes a pair of left and right upper links 71 and a pair of left and right lower links 72 extending parallel to each other.

Each upper link 71 and each lower link 72 extend to incline upward as these links become closer to the rear, and are respectively pin-coupled to the suspension frame of which a rear end extends downward from the underframe 3*a*. Meanwhile, front ends of the upper link 71 and the lower link 72 are pin-coupled to a rear end of the subframe 11. The second suspension mechanism 52 is made rockable in the upward-downward direction with respect to the suspension frame 73 and the subframe 11, according to the relative movement of the suspension frame 73 and the subframe 11 in the upward-downward direction. The second suspension mechanism 52 also has a function as a traction rod for transmitting the driving force or braking force of the tires 13 to the car body 3.

Each air spring 53 has an upper end attached to the underframe 3*a* and has a lower end attached to an upper end of each spring receptacle 22. The air springs 53 relax the relative vertical vibration of the tires 13 with respect to the body 3.

(Steering Guide Device)

As illustrated in FIG. 1, the steering guide device includes a guide frame 31, a guide frame support mechanism 32 for coupling the guide frame 31 to the steering bogies 2, and guide wheels 33 that are rotatably supported by the guide frame 31.

The guide frame 31 is incorporated in the shape of parallel crosses in a plane view as seen from the upward-downward direction, and is arranged below the subframe 11. Specifically, the guide frame 31 includes a pair of left and right of longitudinal beams 34 extending in the forward-rearward direction, and a pair of lateral beams 35 that are coupled to both ends of the longitudinal beams 34 in the forward-rearward direction and extend in the leftward-rightward direction.

Both ends of each longitudinal beam 34 in the forward-rearward direction are located outside each tire 13, and have the lateral beams 35 coupled thereto, respectively.

Both ends of each lateral beam 35 in the leftward-rightward direction are located outside the each tire 13, and are arranged so as to sandwich the tire 13 from both sides in the forward-rearward direction. The guide wheels 33 are attached to both ends of each lateral beam 35 in the leftward-rightward direction one by one.

Each guide wheel 33 is supported so as to be rotatable around a rotational axis O1 extending in the upward-downward direction, and is adapted to roll as a result of contact with each guide rail 6. In the guide frame 31, a branch guide wheel 36 is provided below the guide wheel 33, rolls in contact with the branch guide rail (not illustrated) provided at the track 5, at a branching part in the track 5, and guides the vehicle 1 in a branch direction.

As illustrated in FIG. 2, the guide frame support mechanism 32 includes a base part 37 that supports the guide frame 31, a pair of hanging links 38 that support the base part 37 by hanging from the respective lower arms 62 of the primary suspension mechanism 51, and leftward-rightward restricting links (restricting parts) 39 that couple the base part 37 to the subframe 11 (basal part 21).

The base part 37 is arranged below the subframe 11 at a distance in the upward-downward direction therefrom, and outer ends thereof in the leftward-rightward direction are located inside the outer ends of the primary suspension mechanism 51 (each arm 61 or 62). The base part 37 supports the guide frame 31 via a turning bearing 43 so as to be turnable around a turning axis O2 extending in the upward-downward direction. Specifically, the turning bearing 43 has either an outer ring or an inner ring fixed to the base part 37 and has the other fixed to the guide frame 31.

In the illustrated example, the turning axis O2 is located at a central part of the guide frame 31 in the forward-rearward direction and the leftward-rightward direction.

Each hanging link 38 extends to incline in a direction intersecting the upward-downward direction, specifically, toward the inner side in the leftward-rightward direction as the hanging link becomes closer to the lower side. Accordingly, the distance between lower ends of the respective hanging links 38 in the leftward-rightward direction becomes shorter than the distance between upper ends thereof. The upper end of each hanging link 38 is pin-coupled to the vicinity of the outer end of each lower arm 62 in the leftward-rightward direction, and a lower end thereof is pin-coupled to the outer end of the base part 37 in the leftward-rightward direction. Each hanging link 38 is made rockable in the leftward-rightward direction with respect to the base part 37 and the subframe 11.

The leftward-rightward restricting links 39 extend in the leftward-rightward direction, and are provided in a pair on the front and rear with the subframe 11 (basal part 21) interposed therebetween. One end of each leftward-rightward restricting link 39 in the leftward-rightward direction is pin-coupled to one side of a lower end of the subframe 11 with respect to a central part thereof in the leftward-rightward direction. Additionally, the other end of each leftward-rightward restricting link 39 in the leftward-rightward direction is pin-coupled to the other side of the base part 37 in the leftward-rightward direction with respect to a central part thereof.

The leftward-rightward restricting links 39 are made rockable in the upward-downward direction with respect to the base part 37 and the subframe 11.

(Steering Mechanism)

As illustrated in FIG. 1, the steering mechanism 15 changes the steering angle of the tires 13 in an interlocking manner with the turning of the guide frame 31 around the turning axis O2. The steering mechanism 15 has a steering arm 41 that rocks integrally with each tire 13 (tire attachment shaft 27) on the basis of each kingpin 26, and a steering rod 42 that separately couples each steering arm 41 to the guide frame 31.

The steering rod 42 extends in the leftward-rightward direction, has an outer end pin-coupled to a front end of the steering arm 41, and has an inner end pin-coupled to the guide frame 31.

In such a vehicle 1, if the guide wheels 33 come into contact with the guide rails 6 at the time of traveling, the guide wheels 33 roll and reaction forces act toward the guide wheels 33 from the guide rails 6. If the guide wheels 33 receive the reaction forces, the lateral beams 35 of the above-described guide frame 31 are pressed toward the inner side in the leftward-rightward direction, and thereby, the guide frame 31 turns around the turning axis O2.

For example, in a case where the vehicle 1 travels along a curved portion of the track 5, a guide wheel 33 located on the front side and an outer rail side among the respective guide wheels 33 receives a reaction force toward the inner side in the vehicle width direction from a guide rail 6 arranged on an outer rail side of the curved portion. The reaction force that the guide wheel located on the front side and the outer rail side receives is transmitted to a lateral beam 35 on the front side in the guide frame 31, and the guide frame 31 turns around the turning axis O2. The amount of turning of the guide frame 31 varies according to the size of the curvature radius of the guide rail 6.

If the guide frame 31 turns around the turning axis O2, the steering rod 42 is displaced with this turning, and the tire attachment shaft 27 is rotated around the kingpin 26 via the steering arm 41. Accordingly, the vehicle 1 can be made to travel smoothly along the curved portion by the tires 13 being steered according to the curvature radius of the curved portion.

Here, if the tires 13 are displaced in the upward-downward direction after irregularities of the track 5 at the time of the traveling of the vehicle 1, the primary suspension mechanism 51 rocks in the upward-downward direction to the tires 13 and the subframe 11.

Accordingly, the vibration input to the tires 13 from the track 5 can be absorbed. In this case, the hanging links rock with the rocking operation of the primary suspension mechanism 51 (rocks in the leftward-rightward direction), and thereby, the displacement of the steering guide device 14 to the subframe 11 accompanying the displacement of the primary suspension mechanism 51 is allowed.

Moreover, in this case, the leftward-rightward restricting links 39 rock in an interlocking manner with the displacement of the hanging links 38, and thereby, the subframe 11 and the steering guide device 14 are displaced relative to each other in the upward-downward direction. That is, the rocking operation of the hanging links 38 in the leftward-rightward direction is converted into a rocking operation in the upward-downward direction. Accordingly, the displacement of the guide frame 31 in relative to the subframe 11 in the leftward-rightward direction is restricted within a predetermined range, and the shaking of the guide frame 31 in the leftward-rightward direction with respect to the subframe 11 is suppressed. As a result, a reaction force can be transmitted from the guide rails 6 to the guide wheels 33, and the tires 13 can be steered via the steering guide device 14. Although the guide frame 31 is displaced relative to the subframe 11 in the upward-downward direction due to the rocking of the leftward-rightward restricting links 39, if this relative displacement become smalls as compared to the upward-downward displacement of the air spring 53, the upward-and-downward displacement of the tires 13, or the like. Therefore, the upward-and-downward displacement of the steering guide device 14 (guide wheels 33) is made to fall within the rail width of the guide rails 6, and the guide wheels 33 can be restrained from slipping out of the guide rails 6.

Consequently, according to the present embodiment, the guide frame support mechanism 32 that hangs and supports the guide frame 31 from the primary suspension mechanism 51 is provided. Therefore, unlike a configuration in which the guide frame 31 is supported by being hung from the car body 3 like the related-art independent suspension type, the guide frame 31 can be supported from below the air springs 53 that elastically supports of the car body 3. Accordingly, since it is not necessary to take the displacement of the air springs 53 into consideration with respect to the displacement of the guide frame 31, the upward-and-downward displacement of the guide frame 31 can be suppressed so that the guide wheels 33 fall within the rail width of the guide rails 6. As a result, even in a case where the primary suspension mechanism 51 of the independent suspension type is adopted, it is possible to use the existing guide rails 6, and an increase in facility cost can be suppressed.

Additionally, since the guide frame support mechanism 32 includes the hanging links 38 that rockably support the guide frame 31 in the vehicle width direction with respect to the primary suspension mechanism 51, the displacement of the primary suspension mechanism 51 can be restrained from being hindered by the guide frame 31, and the primary suspension mechanism 51 can be smoothly displaced.

Moreover, in the present embodiment, since the pair of hanging links 38 extends so as to the spacing between both becomes narrow as the hanging links become closer to the lower side. Therefore, the guide frame 31 can be smoothly displaced with respect to the upward-and-downward displacement or the like of the primary suspension mechanism 51.

Moreover, since the hanging links 38 are coupled to the vicinities of the outer ends (tire 13 side) of the primary suspension mechanism 51 in the leftward-rightward direction, the upward-and-downward displacement of the guide frame 31 can be made small by compared to a case where the hanging links are coupled to the vicinities of the inner ends.

Additionally, since the leftward-rightward restricting links 39 that restrict the movement of the guide frame 31 in the leftward-rightward direction in a predetermined range, the shaking of the guide frame 31 in the leftward-rightward direction with respect to the subframe 11 can be suppressed, and reaction forces can be more easily transmitted from the guide rails 6 to the guide wheels 33. Accordingly, the steering guide device 14 can be guided along the guide rails 6.

Since the vehicle 1 of the present embodiment includes the above-described steering bogie 2, as well as an increase in facility cost can be suppressed, the displacement of the steering guide device 14 in the rail width direction of the guide rails 6 can be suppressed, and traveling stability is excellent.

Second Embodiment

Next, a second embodiment of the invention will be described. The present embodiment is different from the first embodiment in that a stopper is used instead of the leftward-rightward restricting links of the first embodiment as the restricting parts. In addition, in the following description, the same components as those of the above-described first embodiment will be designated by the same reference signs, and the description thereof will be omitted.

Figure 4:
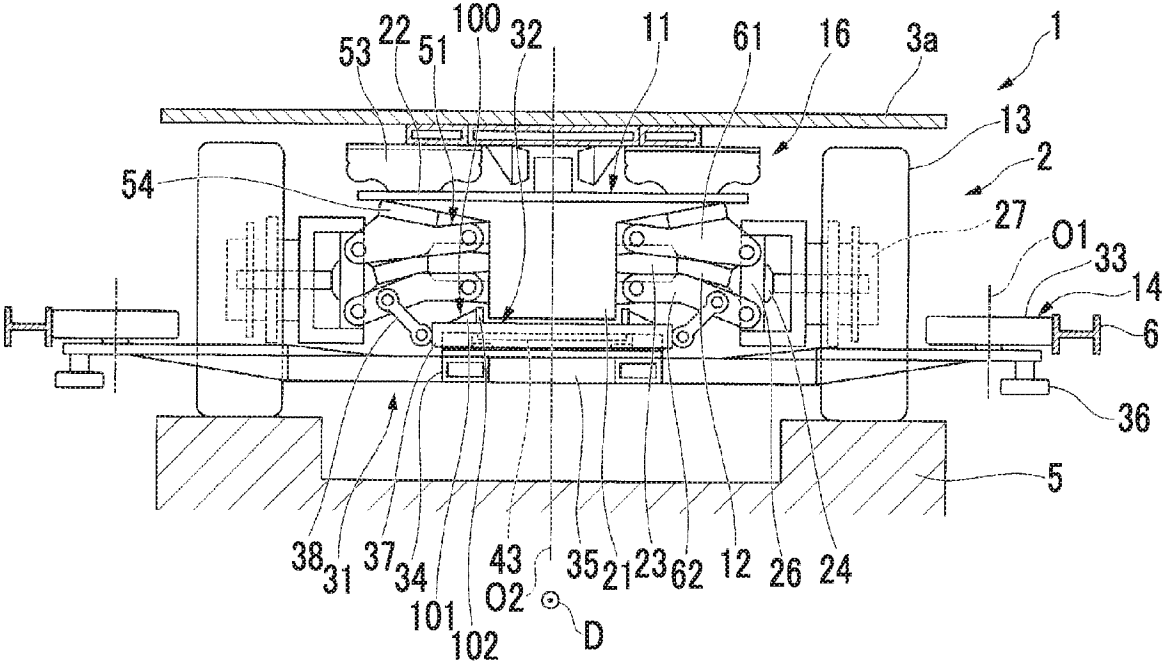
FIG. 4 is a front view equivalent to FIG. 2 in a second embodiment.

As illustrated in FIG. 4, a guide frame support mechanism 100 of the present embodiment includes a pair of stopper parts (restricting parts) 101 that is erected upward from portions located on both sides of the base part 37 in the leftward-rightward direction of the subframe 11. The respective stopper parts 101 are arranged so as to sandwich the subframe 11 from both sides in the leftward-rightward direction in a state where there is a gap in the leftward-rightward direction with respect to the basal part 21 of the subframe 11. Additionally, an elastic member 102 made of rubber or the like is disposed on an inner surface (a surface that faces the subframe 11) of each stopper part 101 located on the inner side in the leftward-rightward direction.

In the present embodiment, if the hanging links 38 rock with the displacement of the primary suspension mechanism 51, and the subframe 11 and the guide frame 31 are displaced relative to each other in the leftward-rightward direction, the subframe 11 (basal part 21) and the stopper parts 101 abut against each other in the leftward-rightward direction via the elastic members 102. That is, the relative displacement of the subframe 11 and the guide frame 31 in the leftward-rightward direction is restricted between the stopper parts 101. Accordingly, the shaking of the guide frame 31 in the leftward-rightward direction with respect to the subframe 11 can be suppressed, reaction forces can be more easily transmitted from the guide rails 6 to the guide wheels 33, and the tires 13 can be steered via the steering guide device 14.

According to the present embodiment, the same effects as the above-described embodiment can be exhibited, and the relative displacement of the subframe 11 and the guide frame 31 in the leftward-rightward direction can be restricted in a predetermined range with the configuration in which the stopper parts 101 are disposed at the base part 37. Accordingly, the configuration can be simplified, and the maintenance can be improved.

Third Embodiment

Next, a third embodiment of the invention will be described. The present embodiment is different from the first and second embodiments in terms of the restricting parts. In addition, in the following description, the same components as those of the above-described first and second embodiments will be designated by the same reference signs, and the description thereof will be omitted.

Figure 5:
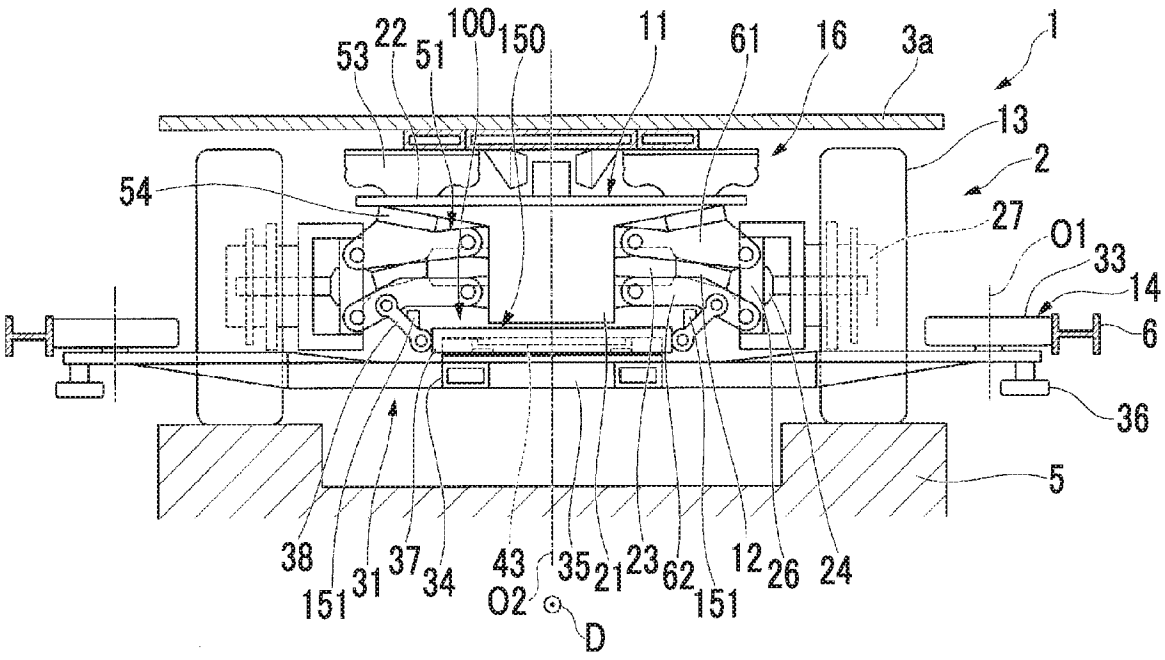
FIG. 5 is a front view equivalent to FIG. 2 in a third embodiment.

As illustrated in FIG. 5, a guide frame support mechanism 150 of the present embodiment has elastic members (restricting parts) 151 provided in the pair of hanging links 38.

The elastic members 151 made of resin, such as urethane, are fixed to the pair of hanging links 38, respectively, extend upward toward the corresponding lower arms 62, respectively, and are made elastically deformable in the extending direction.

A gap is formed between each elastic member 151 and each lower arm 62 in a state where the base part 37 extends in the leftward-rightward direction, that is, in an initial state where the base part 37 does not rock.

Next, an aspect in which the displacement of the base part 37 (and the guide frame 31) relative to the subframe 11 in the leftward-rightward direction is restricted will be described with reference to FIG. 6.

Figure 6:
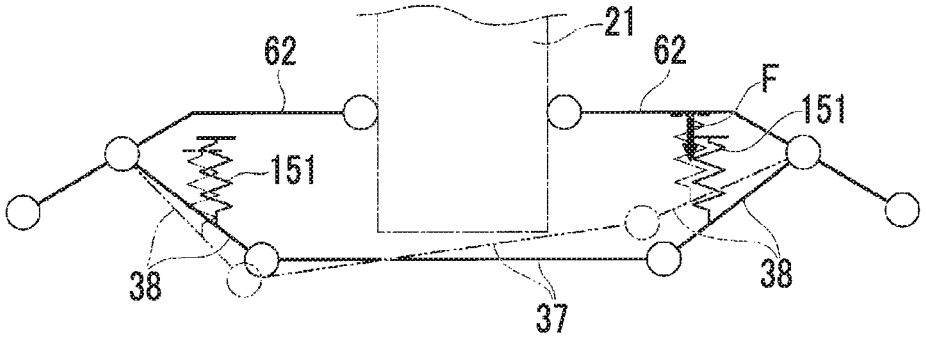
FIG. 6 is a front view schematically illustrating a guide frame support mechanism in the third embodiment.

If the base part 37 rocks, as illustrated by a two-dot chain line of FIG. 6, the pair of hanging links 38 rotates about positions where the hanging links are pin-coupled the lower arms 62 and the base part 37. As a result, the pair of hanging links 38 inclines in the leftward-rightward direction from their initial positions (positions before rocking), the base part 37 inclines with respect to the lower arms 62. In this case, the spacing in the upward-downward direction between one hanging link 38 and one lower arm 62 at a position where an elastic member 151 is provided becomes small, and the elastic member 151 comes into contact with the lower arm 62 and is elastically deformed under a force from the lower arm 62. Then, a biasing force F acts toward the hanging link 38 from the lower arm 62.

According to the present embodiment, by providing the elastic member 151 as a restricting part, the biasing force F tries to return the hanging link 38 to its initial position (a position before rocking). That is, the biasing force F becomes a force to restore the position of the guide frame 31 so that the guide frame 31 returns to its initial state where the guide frame does not rock. Therefore, the shaking of the guide frame 31 in the leftward-rightward direction with respect to the subframe 11 can be suppressed, reaction forces can be more easily transmitted from the guide rails 6 to the guide wheels 33. Accordingly, the steering guide device 14 can be guided along the guide rails 6.

Moreover, since the elastic members 151 can be installed, for example, simply by being attached to the hanging links 38 with bolts or the like, the installation is easy, and the elastic members can be easily replaced, which leads to improvements in maintenance.

Additionally, by appropriately selecting the size of the gap between each elastic member 151 and each lower arm 62 and the magnitude of the elastic modulus of the elastic members 151 can be appropriately selected, and it is also possible to minimize an influence on the operation of the lower arms 62.

In the present embodiment, the elastic members 151 are not limited to those made of urethane. For example, disk springs, coil springs, or the like can be used for the elastic members 151 according to limitations of an installation space.

Figure 7:
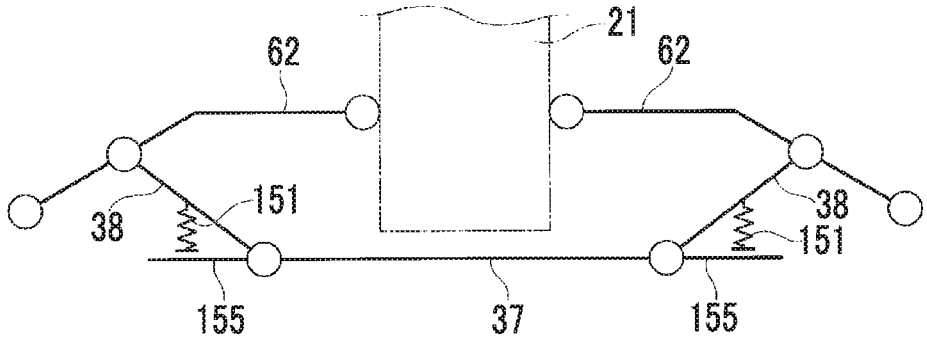
FIG. 7 is a front view schematically illustrating the guide frame support mechanism in a first modification example of the third embodiment.

Additionally, the installation positions of the elastic members 151 are not limited to the above-described case. For example, as illustrated in FIG. 7, the elastic members 151 are fixed to the pair of hanging links 38, respectively, and may extend toward the base part 37. In this case, extending parts 155 that protrude in the leftward-rightward direction further from positions where the base parts 37 are pin-coupled to the hanging links 38 are formed in the base part 37.

A gap is formed between each elastic member 151 and the base part 37 in a state where the base part 37 extends in the leftward-rightward direction, that is, in an initial state where the base part 37 does not rock.

If the base part 37 rocks and the hanging links 38 incline from their initial positions, the elastic members 151 come into contact with the extending parts 155 and are elastically deformed, and the biasing forces F act toward the hanging links 38 from the base part 37. AS a result, forces to restore the position of the guide frame 31 act so that the guide frame 31 returns to its initial state where the guide frame does not rock.

Figure 8:
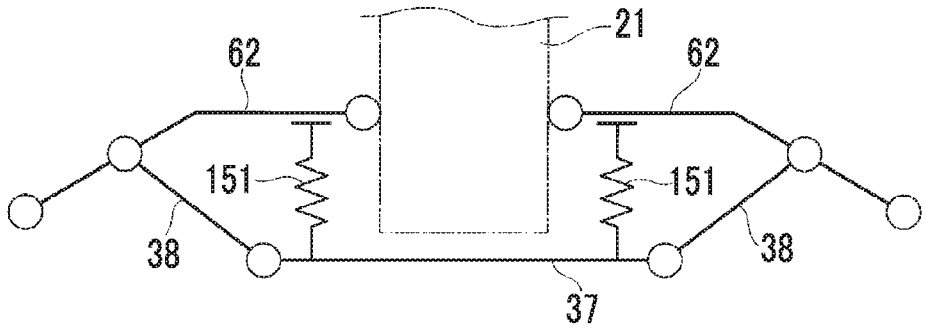
FIG. 8 is a front view schematically illustrating the guide frame support mechanism in a second modification example of the third embodiment.

Moreover, as illustrated in FIG. 8, the elastic members 151 may be provided in the base part 37 apart from each other in the leftward-rightward direction, and may extend toward the lower arms 62. In the example of FIG. 8, a pair of elastic members 151 is provided so as to become symmetrical with a central position of the base part 37 in the leftward-rightward direction as a reference.

A gap is formed between each elastic member 151 and each lower arm 62 in a state where the base part 37 extends in the leftward-rightward direction, that is, in an initial state where the base part 37 does not rock.

Even in this case, if the base part 37 rocks and the hanging links 38 incline from their initial positions, the elastic members 151 come into contact with the lower arms 62 and are elastically deformed, and the biasing forces F act toward the base part 37 from the lower arms 62. AS a result, forces to restore the position of the guide frame 31 act so that the guide frame 31 returns to its initial state where the guide frame does not rock.

Figure 9:
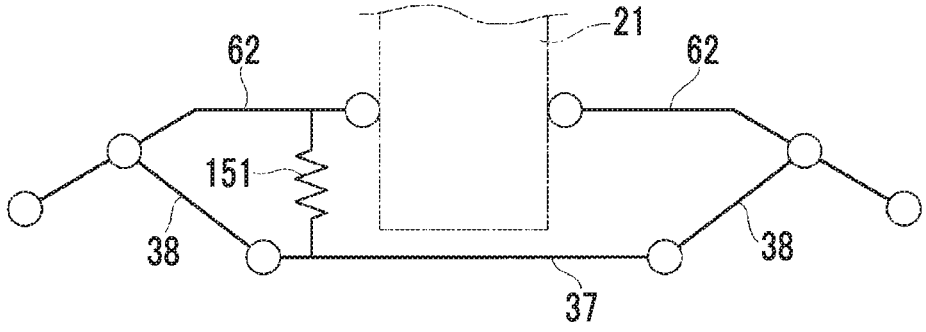
FIG. 9 is a front view schematically illustrating the guide frame support mechanism in a third modification example of the third embodiment.

Additionally, as illustrated in FIG. 9, only one elastic member 151 may be provided in the base part 37. In this case, the elastic member 151 is provided at a position shifted to either the left or the right from a central position of the base part 37 in the leftward-rightward direction, and is also fixed to a lower arm 62.

Also in an example of FIGS. 6 to 8, similarly to an example of FIG. 9, both ends of the elastic member 151 may be fixed to the base part 37 and the lower arm 62, respectively.

Fourth Embodiment

Next, a fourth embodiment of the invention will be described. The present embodiment is different from the first to third embodiments in terms of the restricting parts. In addition, in the following description, the same components as those of the above-described first to third embodiments will be designated by the same reference signs, and the description thereof will be omitted.

Figure 10:
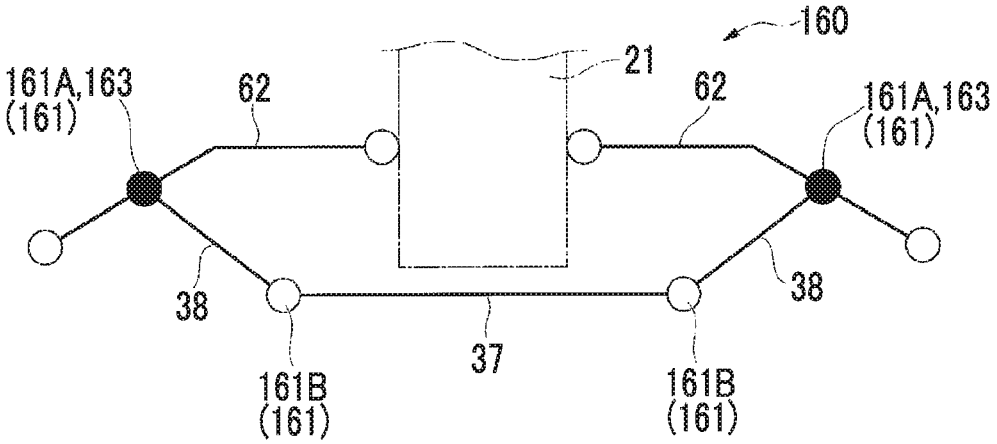
FIG. 10 is a front view schematically illustrating a guide frame support mechanism in a fourth embodiment.

As illustrated in FIG. 10, in a guide frame support mechanism 160 of the present embodiment, similar to the first to third embodiments, the pair of hanging links 38 is pin-coupled to the lower arms 62 and the base part 37.

That is, the guide frame support mechanism 160 includes joint parts 161 in portions in the vicinity of outer ends of the pin-coupled lower arms 62 and in outer ends of the base part 37 in the leftward-rightward direction.

The joint parts 161 turn the base part 37 and the lower arms 62 and the hanging links 38 relative to each other with axes, extending in the forward-rearward direction that intersects (is orthogonal to) the leftward-rightward direction and the upward-downward direction, as centers, thereby rockably supporting the guide frame 31 in the vehicle width direction with respect to the primary suspension mechanism 51.

Here, a pair of joint parts 161 between the lower arms 62 and the hanging links 38 is referred to as joint parts 161A, respectively, and a pair of joint parts 161 between the base part 37 and the hanging links 38 is referred to as joint parts 161B, respectively.

The guide frame support mechanism 160 of the present embodiment has the elastic members (restricting parts) 163 provided in the joint parts 161A.

Figure 11:
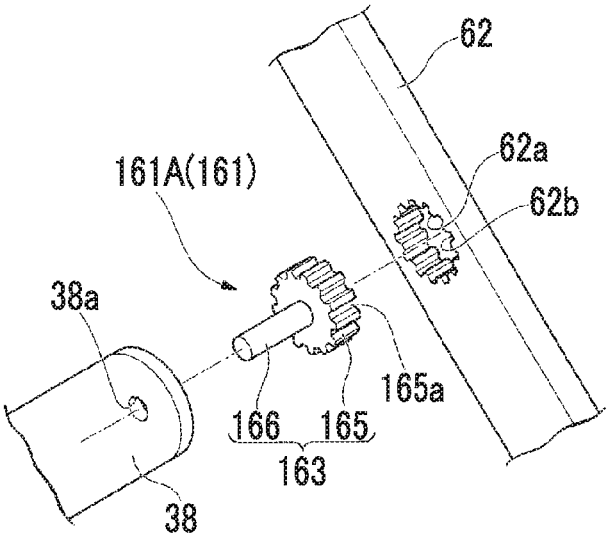
FIG. 11 is a perspective view illustrating the periphery of a joint part of the guide frame support mechanism in the fourth embodiment in an enlarged manner.

As illustrated in FIG. 11, each elastic member 163 has an insertion part 165 inserted into a hole 62*a* formed so that extend in the forward-rearward direction, at a position in the vicinity of an outer end of each lower arm 62, and a torsion bar spring 166 as a pin for pin coupling that is fixed to the insertion part 165 and extends in the forward-rearward direction.

An inner peripheral surface of the hole 62*a* formed in the lower arm 62 has serrations 62*b* extending in the forward-rearward direction. An outer peripheral surface of the insertion part 165 also has serrations 165*a* so as to correspond to the serrations 62*b*. Accordingly, the insertion part 165 is held within the hole 62*a* so as to restrict relative rotation. The insertion part 165 is formed of, for example, metal or the like.

The torsion bar spring 166 is formed of metal or the like. A hole 38*a* extending in the forward-rearward direction is formed at an upper end of each hanging link 38, and the torsion bar spring 166 is press-fitted into the hole 38*a* and hangs, and is made non-rotatable to the hanging link 38.

The torsion bar spring 166 generates an elastic restoring force if a rotative force around an axis running in the forward-rearward direction is received, that is, if a force is received in a torsion direction.

According to the present embodiment, when the base part 37 and the guide frame 31 rock in the leftward-rightward direction, the pair of hanging links 38 inclined from their initial positions, and the base part 37 inclines with respect to the lower arms 62. In this case, in the joint parts 161, the base part 37 and the lower arms 62, and the hanging links 38 turn relative to each other with the axes extending in the forward-rearward direction as centers. Then, in the joint parts 161A, the torsion bar springs 166 are elastically deformed, and elastic restoring forces to restore the position of the guide frame 31 to its initial state where the guide frame 31 does not rock, that is, a state where the guide frame is disposed in the leftward-rightward direction, are generated.

Therefore, the shaking of the guide frame 31 in the leftward-rightward direction with respect to the subframe 11 can be suppressed, reaction forces can be more easily transmitted from the guide rails 6 to the guide wheels 33. Accordingly, the steering guide device 14 can be guided along the guide rails 6.

In the present embodiment, both of the pair of joint parts 161A is provided with the elastic members 163 serving as the restricting parts. For example, however, the elastic members may also be provided in the pair of joint parts 161B. Additionally, it is sufficient if only an elastic member 163 is provided in at least one joint part 161.

Additionally, the elastic member 163 may have an ordinary pin having the same shape as the torsion bar spring 166 instead of the torsion bar spring 166, and a rubber member made of resin that is interposed between the pin and the hole 38*a*.

Even in such a case, if the base part 37 and the lower arms 62, and the hanging links 38 turns relative to each other, the above rubber member is elastically deformed in the joint part 161A, and an elastic restoring force to restore the position of the guide frame 31 to its initial state where the guide frame 31 does not rocks is generated.

In addition, it should be understood that the technical scope of the invention is not limited to the above-described embodiments, but various modifications may be made to the above-described embodiments without departing from the spirit of the invention. That is, the specific structures, configurations, or the like mentioned in the embodiments are merely examples, and can be appropriately changed.

For example, a configuration using a so-called single tire in which one tire 13 as a running wheel is attached to each tire attachment shaft 27 has been described in the above-described embodiments. However, the invention is not limited to this. For example, a dual tire in which two tires 13 are attached to each tire attachment shaft 27 may be used. Additionally, three or more tires 13 may be attached to each tire attachment shaft 27.

Moreover, a configuration in which a double wishbone type is adopted as the primary suspension mechanism 51 of the independent suspension type has been described in the above-described embodiments. However, the invention is not limited to this. For example, various independent suspension types, such as a swing axle type, can be adopted.

Moreover, a configuration in which the steering bogie of the invention is adopted for the vehicle of the track-based transportation system has been described in the above-described embodiments. However, the invention is not limited to this, and it is possible to adopt the steering bogie for various vehicles.

Additionally, a configuration in which the respective hanging links 38 are arranged so as to extend toward the inner side in the leftward-rightward direction as the hanging links become closer to the lower side has been described in the above-described embodiments. However, the invention is not limited to this, and the respective hanging links 38 may be arranged parallel to each other. According to this configuration, components in the upward-downward direction when the base part 37 (guide frame 31) and the subframe 11 are displaced relative to each other in the leftward-rightward direction via the hanging links 38 can be made small. That is, the guide frame 31 and the subframe 11 are easily displaced relative to each other in the vehicle width direction, and the inclination or the like of the guide frame 31 in the upward-downward direction with respect to the subframe 11 can be suppressed.

Moreover, a configuration in which the respective hanging links 38 extends toward the inner side in the leftward-rightward direction as the hanging links become closer to the lower side has been described in the above-described embodiments. However, the invention is not limited to this, and the hanging links extend toward the outer side in the leftward-rightward direction as the hanging links become closer to the lower side.

INDUSTRIAL APPLICABILITY

According to the above steering bogie and the above vehicle, as well as an increase in facility cost can be suppressed, the displacement of the steering guide device in the width direction of the guide rails can be suppressed.

REFERENCE SIGNS LIST

1: VEHICLE
2: STEERING BOGIE
3: CAR BODY
5: TRACK
6: GUIDE RAIL
11: SUBFRAME (FRAME)
13: TIRE (RUNNING WHEEL)
14: STEERING GUIDE DEVICE
15: STEERING MECHANISM
16: SUSPENSION DEVICE
31: GUIDE FRAME
32, 100, 150, 160: GUIDE FRAME SUPPORT MECHANISM
33: GUIDE WHEEL
38: HANGING LINK
39: LEFTWARD-RIGHTWARD RESTRICTING LINK (RESTRICTING PART)
43: TURNING BEARING
51: PRIMARY SUSPENSION MECHANISM (SUSPENSION MECHANISM)
101: STOPPER PART (RESTRICTING PART) 151, 163: ELASTIC MEMBER
161 (161A, 161B): JOINT PART

The invention claimed is:

1. A steering bogie comprising:
a pair of running wheels that is disposed on both sides in a vehicle width direction;
a suspension mechanism that supports the pair of running wheels independently from a frame; and
a steering guide device that is guided along a guide rail extending along a track,
wherein the steering guide device includes a guide frame,
a guide wheel that is configured to roll as a result of contact with the guide rail and is rotatably supported by the guide frame, and
a guide frame support mechanism that supports the guide frame by hanging from the suspension mechanism.

2. The steering bogie according to claim 1,
wherein the guide frame support mechanism includes a pair of hanging links that supports the guide frame so as to be rockable in the vehicle width direction with respect to the suspension mechanism.

3. The steering bogie according to claim 2,
wherein the pair of hanging links extend so that the spacing between the pair of hanging links in the vehicle width direction becomes narrow as the hanging links become closer to one side running in an upward-downward direction.

4. The steering bogie according to claim 2, wherein the pair of hanging links extends parallel to each other in an upward-downward direction.

5. The steering bogie according to claim 1, wherein the guide frame support mechanism includes a restricting part that restricts the displacement of the guide frame in the vehicle width direction relative to the frame within a predetermined range.

6. The steering bogie according to claim 5, wherein the guide frame support mechanism includes a pair of hanging links that supports the guide frame so as to be rockable in the vehicle width direction with respect to the suspension mechanism, and wherein the restricting part has elastic members that are provided in the pair of hanging links, extend toward the suspension mechanism or the guide frame, and are elastically deformable in a direction of the extension.

7. The steering bogie according to claim 5, wherein the guide frame support mechanism includes a pair of hanging links that supports the guide frame so as to be rockable in the vehicle width direction with respect to the suspension mechanism, and wherein the restricting part has an elastic member that is provided in the guide frame, extends toward the suspension mechanism, and is elastically deformable in a direction of the extension.

8. The steering bogie according to claim 5, wherein the guide frame support mechanism includes a pair of hanging links that is provided apart from each other in the vehicle width direction between the guide frame and the suspension mechanism, and a joint part that is provided between each of the pair of hanging links, and the guide frame and the suspension mechanism, and turns the guide frame and the suspension mechanism relative to each hanging link with an axis, extending in a direction intersecting the vehicle width direction and an upward-downward direction, as a center, thereby supporting the guide frame so as to be rockable in the vehicle width direction with respect to the suspension mechanism, wherein the restricting part has an elastic member that is provided in at least one of the joint parts and generates an elastic restoring force during the relative turning.

9. The steering bogie according to claim 1, further comprising:

a turning bearing that is disposed between the guide frame support mechanism and the guide frame and supports the guide frame so as to be turnable around a turning axis extending in an upward-downward direction with respect to the guide frame support mechanism; and a steering mechanism that steers the running wheels in an interlocking manner with the turning of the guide frame.

10. A vehicle comprising:

a car body; and the steering bogie according to claim 1 that is provided in a lower part of the car body.

* * * * *